US005157995A

United States Patent [19]

Nogues

[11] Patent Number: 5,157,995

[45] Date of Patent: Oct. 27, 1992

[54] MULTIPLE SOCKET WRENCH

[76] Inventor: Nelson E. Nogues, 235 SW. Le Jeune Rd., Miami, Fla. 33134

[21] Appl. No.: 764,602

[22] Filed: Sep. 24, 1991

[51] Int. Cl.[5] ..... B25B 13/06

[52] U.S. Cl. ..... 81/124.5; 81/124.6; 81/185; 81/DIG. 11

[58] Field of Search ..... 81/124.5, 124.4, 124.6, 81/124.7, 185, 185.2, DIG. 11

[56] References Cited

U.S. PATENT DOCUMENTS

| | | | |
|---|---|---|---|
| 1,471,451 | 10/1923 | Crimp | 81/124.5 X |
| 1,896,949 | 2/1933 | Greiner | 81/185 |
| 1,997,948 | 4/1935 | Pearson . | |
| 2,735,325 | 2/1956 | Rudd, Sr. | 81/185 X |
| 3,233,482 | 9/1964 | Jaehne . | |
| 3,298,261 | 5/1965 | Lynn . | |

*Primary Examiner*—D. S. Meislin
*Attorney, Agent, or Firm*—Jesus Sanchelima

[57] ABSTRACT

A tool having several coaxially disposed socket members housed within each other and corresponding to conventional sizes. The sockets are spring loaded, and each reduces its diameter towards the outer end that prevents the abutting sockets contained therein from falling off as a result of gravity or the spring force of the different spring members associated with each one of the sockets. The springs members urge these sockets outwardly, and the springs members of the sockets that are smaller than the head of the bolt or screw being matched are overcome and retracted, thereby the matching socket cooperatively engages with the head. Corresponding covers provide the necessary support area for the springs to exert their force against their corresponding socket members. An upper master socket assembly is removably mounted to the larger socket member, and it provides suitable engagement for a crank or lever to produce the necessary torque to rotate the socket members.

4 Claims, 2 Drawing Sheets

MULTIPLE SOCKET WRENCH

BACKGROUND OF THE INVENTION

1. Field of the Invention

The present invention relates to a multiple socket tool, and more particularly, to the type of tools that can readily and automatically select the proper socket.

2. Description of the Related Art

A number of tools have been designed in the past that contain a plurality of sizes for different sockets to be utilized. However, none of them provide the features of automatically selecting the proper socket size by matching it with the head characteristics of the fastening device being worked on while at the same time providing a reliable and structurally stable tool that can be used in remote areas with one hand.

Applicant believes that the closest reference corresponds to U.S. Pat. No. 1,997,948 issued to A. Pearson. However, it differs from the present invention because it requires the use of a pin or bar 53 (requiring the use of both hands) to select the proper socket.

Another related reference correspond to U.S. Pat. No. 3,298,261 issued to Lynn. However, this wrench requires time consuming secondary operations to bend projections 30 and 31.

Still another reference correspond to U.S. Pat. No. 3,233,482 issued to Jaehne. This device requires the use of co-axially disposed spring 26 and 28 that interact and obstruct each other when compressed.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a tool that can regularly and automatically select the proper socket that will cooperate with the fastening device being worked on.

It is another object of the present invention to provide such a tool that can be regularly utilized by a user in remote areas.

It is still another object of this invention to provide such a tool that will keep in place all sockets without requiring disassembly prior to operation.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
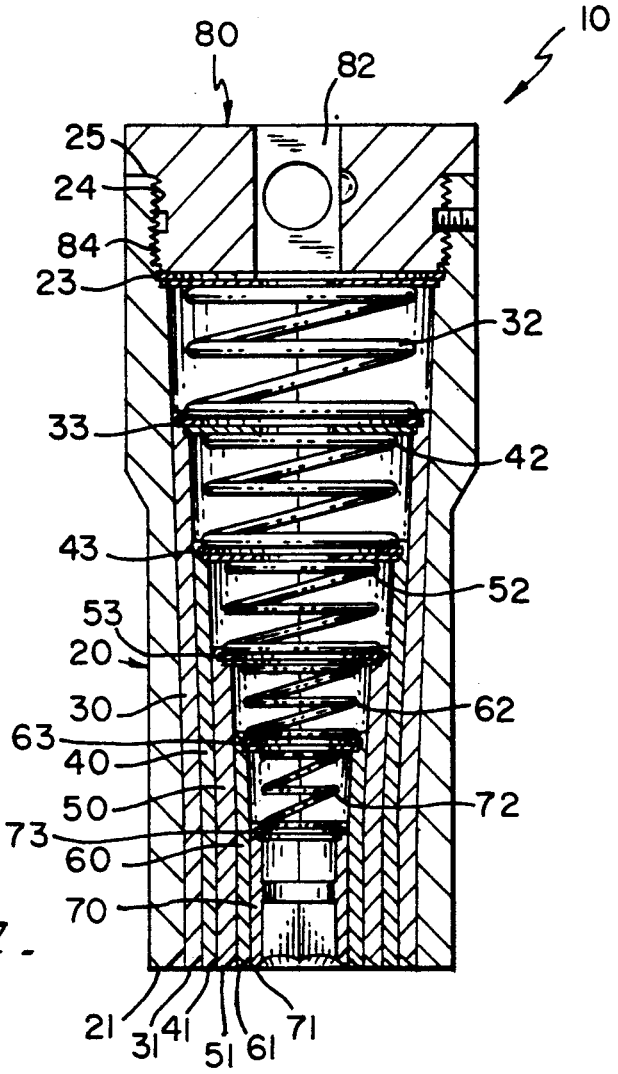
FIG. 1 represents a cross-sectional side elevational view of the present invention showing the multiple sockets.
Figure 2:
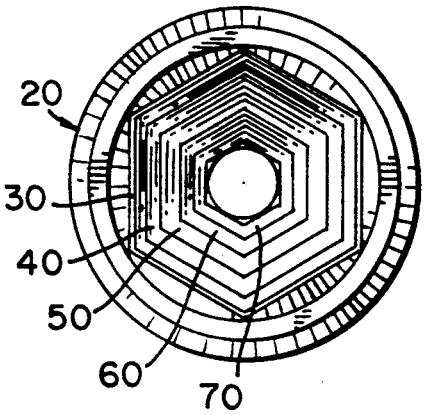
FIG. 2 is a bottom view of the preferred embodiment of the present invention.
Figure 3:
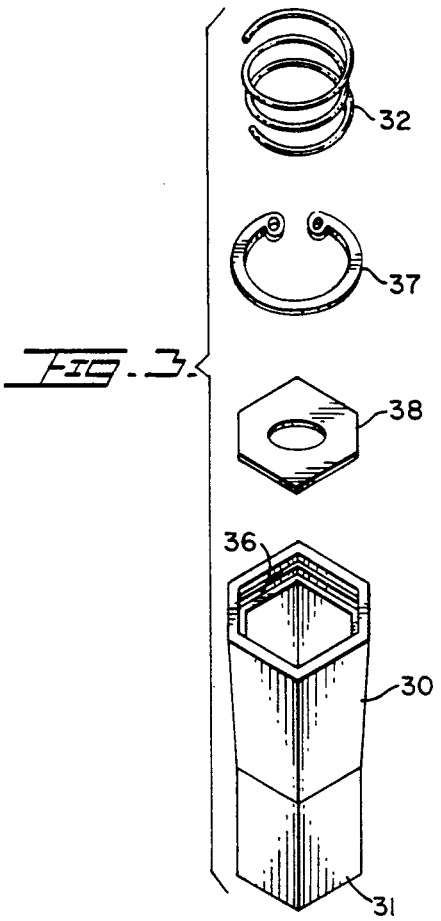
FIG. 3 is an exploded view of one of the sockets of the present invention with its associated sub-components.

Referring now to the drawings, where the present invention is generally referred to with numeral 10, it can be observed that it basically includes several elongated tubular sockets 20; 30; 40; 50; 60 and 70 that are coaxially disposed within each other. These sockets are designed to fit, preferably, at one end on conventional hexagonal heads of bolts, screws, and nuts. The sockets can accept heads or nuts that are square or hexagonal.

Associated with sockets 30 through 70 are spring members 32; 42; 52; 62 and 72 that urge the respective sockets outwardly from larger and outer socket 20. Outer socket 20 also includes inner threaded portion 24 adjacent to end 25. Crank socket 80 has a substantially cylindrical shape and at one end includes outer threaded portion 84 on its external surface. Crank socket 80 is also provided with central cavity 82 that cooperatively receives handle coupling member 86 (shown in FIG. 4) used to impart the necessary force given by a user. Set screw 85 locks crank socket 80 in place with respect to socket 20.

Sockets 20 through 70 reduce their diameters towards their lower end sufficiently to prevent them from falling off by either the force of gravity or the action of spring members 32 through 72. In the preferred embodiment, sockets 20 through 70 have an hexagonal cross-section.

Sockets 20 through 70 have corresponding covers 28; 38; 48; 58; 68 and 78 that are positioned substantially adjacent to upper ends 25; 35; 45; 55; 65 and 75 of their respective sockets and resting on internal steps 26; 36; 46; 56; 66; and 76, respectively. The function of these covers is to provide an area where spring members 32 through 72 can exert their outwardly axial force. Covers 38 through 78 include, preferably, a central opening 38' through 78' to permit the shank of long bolts being worked on to go through, if necessary. Each spring member 32 through 72 works independently from each other. Retainer rings 27; 37; 47; 57; 67 and 77 are spring loaded and positioned inside internal peripheral slots 23; 33; 43; 53; 63; and 73, respectively. Their function is to keep respective cover members 28 through 78 in place thereby providing an area for spring members 32 through 72 to exert their axial forces. Ends 21; 31; 41; 51; 61 and 71 include, in the preferred embodiment, slight slants 29; 39; 49; 59; 69 and 79 that facilitates the engagement of the proper socket to the head being matched, even without requiring a user to look at it. This is specially helpful when the piece is in remote areas. Tool 10 can also be used with one hand only.

Figure 4:
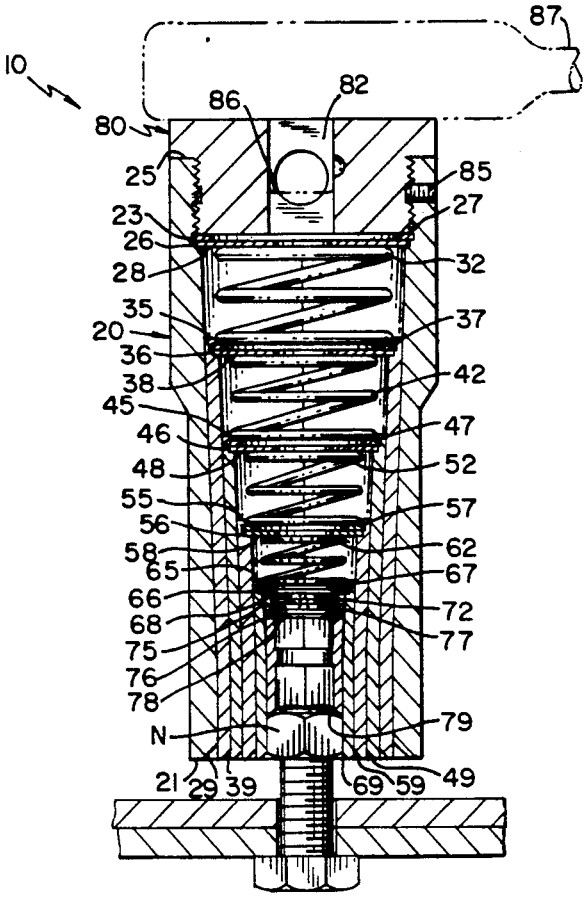
FIG. 4 is a cross-sectional side view in elevation showing the tool subject of this application in engagement with a nut.
Figure 5:
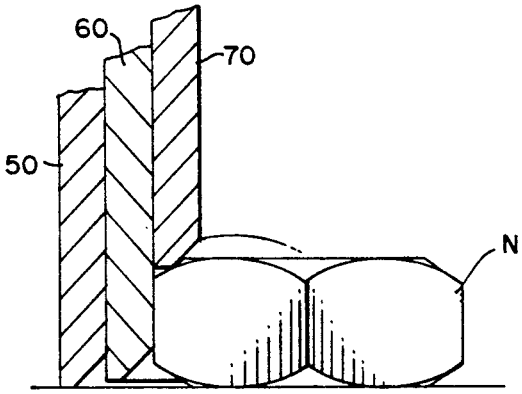
FIG. 5 is a partial detail view of the socket engagement with a nut.

In operation, as seen in FIG. 4, when a user brings the ends 21 through 71 in contact with nut N, slight movements will eventually bring the abutting end of nut N in alignment with the proper slant portions 29 through 79 that matches the dimension of nut N. Once nut N is matched, a user pushes crank socket 80 against nut N causing all socket members with smaller dimensions that nut N to move inwardly thereby compressing their respective spring members. Spring members 22 through 72 have different compression coefficients. Handle member 87 engages central opening 82 to impart the necessary rotational force to tool 10. The spring members associated with the larger sockets requiring a larger compression force than the smaller ones. Therefore, the compression coefficient of the larger spring member is higher thereby requiring more force for compression. This causes a minimum axial displacement of the next larger size socket member as best seen in FIG. 5.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A tool for driving hexagonal head fastening members comprising:

A. a plurality of tubular socket means coaxially housed within each other and each one of said socket means having upper and lower ends, said lower ends having a socket termination that cooperatively receives said head of said fastening member and the inner diameters of said plurality of tubular socket means decreasing from the upper ends to the lower ends except for said socket termination; and wherein each one of said tubular socket means, except the largest one, further include ring cover means removably mounted substantially adjacent to said upper ends of said tubular socket means so that a suitable support surface is provided to the associated spring means to exert the necessary force to push the adjacent smaller tubular socket means out; and furthermore wherein each one of said tubular socket means further includes retaining ring means for keeping said ring cover means in place; and B. a corresponding plurality of spring means for urging each of said socket means outwardly from the adjacent larger socket means that houses the adjacent smaller socket means with the exception of the largest socket means so that said plurality of tubular socket means is kept in coaxial abuttment against each other; and wherein said plurality spring means have a coefficient of compression that requires a greater compression force than spring means housed by smaller tubular socket means; and C. a crank socket assembly removably mounted to the upper end of the largest of said socket means and further including lever means for imparting a rotational force to said crank socket assembly.

2. The tool set forth in claim 1 wherein said crank socket assembly further includes means for removably locking said crank socket assembly with respect to said largest tubular socket means.

3. The tool set forth in claim 2 wherein said largest tubular socket means includes an internal thread adjacent to its upper end and said crank socket assembly includes a cooperatively mating outer thread and further including set screw means for locking them in place with respect to each other.

4. The tool set forth in claim 3 wherein said ring cover means of each one of said tubular socket means includes a central opening.

* * * * *